US006035496A

United States Patent [19]

Germani

[11] Patent Number: 6,035,496

[45] Date of Patent: Mar. 14, 2000

[54] LINEAR PROFILE, WHICH IS SELF-SEALING BY MECHANICAL ENGAGEMENT

[76] Inventor: Gianfranco Germani, Via S. Primo, 8-20121, Milan, Italy

[21] Appl. No.: 09/219,144

[22] Filed: Dec. 22, 1998

[30] Foreign Application Priority Data

Jan. 29, 1998 [IT] Italy ..... MI98A0161

[51] Int. Cl.[7] ..... A44B 19/00

[52] U.S. Cl. ..... 24/389; 24/384; 24/390; 24/437

[58] Field of Search ..... 24/389, 384, 390, 24/437, 543

[56] References Cited

U.S. PATENT DOCUMENTS

| | | | |
|---|---|---|---|
| 2,557,163 | 6/1951 | Williams | 24/389 |
| 3,409,953 | 11/1968 | Briscoe . | |
| 3,892,016 | 7/1975 | Brown | 24/389 |
| 4,488,338 | 12/1984 | Takahashi . | |
| 4,513,482 | 4/1985 | Fukuroi . | |
| 4,658,480 | 4/1987 | Morioka et al. . | |
| 4,817,252 | 4/1989 | Kusayama | 24/384 |
| 4,823,446 | 4/1989 | Tsubata et al. | 24/389 |
| 4,941,238 | 7/1990 | Clark | 24/389 |

FOREIGN PATENT DOCUMENTS 0 095 161 11/1983 European Pat. Off. .

*Primary Examiner*—Victor N. Sakran
*Attorney, Agent, or Firm*—Brinks Hofer Gilson & Lione

[57] ABSTRACT

A linear profile, which is self-sealing by mechanical engagement comprising an elastic element (100), engagement elements (20) and a slider (31); the elastic element (100) consists of a pair of seals (2), specular or preferably complementary with hollows (15) facing in opposite directions; each seal (2) having a honeycombed rib (14) in which cavities (13) are made for insertion of the engagement elements (20); the slider (31) is able to abut against the engagement elements (20) to bring about closure of the seals (2).

8 Claims, 3 Drawing Sheets

LINEAR PROFILE, WHICH IS SELF-SEALING BY MECHANICAL ENGAGEMENT

DESCRIPTION

The present invention relates to a linear profile, which is self-sealing by mechanical engagement, more commonly known as an airtight/watertight slide fastener.

This invention is particularly suitable for civilian and military uses such as for watertight and airtight slide fasteners used in underwater diving suits, in camp tents, and in airtight containers and the like.

Products similar in use and field of application have been known and marketed for a long time.

The most widely used model of slide fastener consists of two strips of rubberized or waterproofed fabric having sides suitably pre-folded into an S-shape to which a series of metal engaging teeth is applied.

The engaging elements interfere with each other through sliding of a slider, forcing together the opposite folds of fabric inside which they are held. In a top sectional view the slider is substantially Y-shaped. From this observation it can be understood that even when the slider is stationary at the end of its stroke the two edges of fabric held therein remain open. Because of this, the required watertightness/airtightness of said closure is obtained through the addition by overlaying of an end stop seal suitable to collimate with the inner/outer profile of said slider.

Said operation entails delicate technical and qualitative problems with consequent significant repercussions on the already high production costs.

A second type of airtight/watertight closure, more recently introduced but with inferior performance compared to the previous one uses four coils obtained by thermoforming of a synthetic monofilament as engagement elements.

Said coils are then fixed by sewing to a strip of coated fabric which is subsequently folded back over itself along its longitudinal axis and lastly welded between two surfaces inside the fold. Interlocking or mutual engagement of the four opposite spirals, obtained through sliding of a slider, in this case forces together the two folded edges. In this case also, parking of the slider at the end of its stroke involves application by overlaying of a seal suitable to tightly fit around the inner and outer surface of said slider.

As can be understood from the above description, slide fasteners according to the prior art present some drawbacks.

The metal or synthetic engagement elements can be applied only to strips of waterproofed fabric. In addition seals or tight end stops must be created by overlaying at each end of the slide fastener.

Slide fasteners according to the prior art therefore not only have a certain complexity of construction but also have high production costs.

Furthermore, the degree of sealing through drawing together of opposite folds of fabric is determined and maintained due to the reciprocal interference of the mechanical engagement elements. Gas and hydraulic pressure exerted on the seal during practical use cannot therefore determine any self-balancing effect for the progressive and proportional increase of the adherence pressure of the sealing edges as the pressures from the outer environment change.

The object of the invention is to eliminate said drawbacks by providing an economical watertight/airtight slide fastener that is simple to make and capable of providing a self-balancing effect to the stresses to which it is subjected.

This object is achieved, according to the invention, with the characteristics listed.

Preferred embodiments of the invention emerge from the dependent claims.

In the watertight/airtight slide fastener according to the invention, there is a profile of elastic material produced by extrusion of rubber or other thermoplastic elastomers or through a single molding operation. This profile comprises two half-chains each consisting of a double-lipped seal, U-shaped in section, the shorter side of which consists of a honeycombed rib in which cavities for housing the teeth of an engagement element are made. In the case of the profile being produced by extrusion, the through cavities for housing the engagement elements are obtained by means of a subsequent mechanical shearing operation. Connected to the two half-chains of the profile there is an elastic side membrane capable of being easily deformed to damp and cushion possible tensions and overloads on the structure.

The engagement element consists of a series of teeth connected to one another by means of a textile cord that determines regularity of the pitch and longitudinal stability. The single teeth of the engagement element are forced into the housings provided for this purpose in the double-lipped seals in such a manner as to ensure that they are elastically retained. The two opposite double-lipped seals are closed and maintained in this state through the effect of mutual engagement of the engagement elements. This operation is performed by a slider.

Manual running of the slider along the seal in the open state causes progressive drawing together of the engagement elements contained therein and thus forced interlocking thereof. On completion of the closing stroke the slider maintains the opposite profiles held therein in a state of forced reciprocal opposition.

Subsequent sliding of the slider in the opposite direction to that of closure allows progressive shifting and disengagement of the elements, with consequent opening of the seal.

To stop the stroke of the slider an end stop is provided on the seal and is produced by injection of added elastic material around an added end stop element. Said added elastic material further forms a joining membrane on the inner side along the terminal portion of the seal. This membrane, extending downward from the stopping point of the slider at the end of its stroke, ensures the watertightness/airtightness of the system.

In the case of production through molding the end stop is made in the profile directly during the molding stage. The slider comes to rest against the end stop and is locked in a terminal slider parking profile.

From what has been described it is obvious that the linear profile, which is self-sealing by mechanical engagement according to the invention, has engagement elements that are less costly and easier to make than those of the prior art.

In the case of the profile being made in a single molding operation, production proves more simple and economical since it does not require a further overlaying to make the end stop.

The material used to make the profile is an elastomer which has the advantage of ensuring a better seal than the fabric material of the known art, self-balancing the tensile stress to which the profile is subjected.

Further characteristics of the invention will be made clearer by the detailed description that follows, referring to a purely exemplary and therefore non-limiting embodiment thereof, illustrated in the appended drawings, in which.

Figure 1:
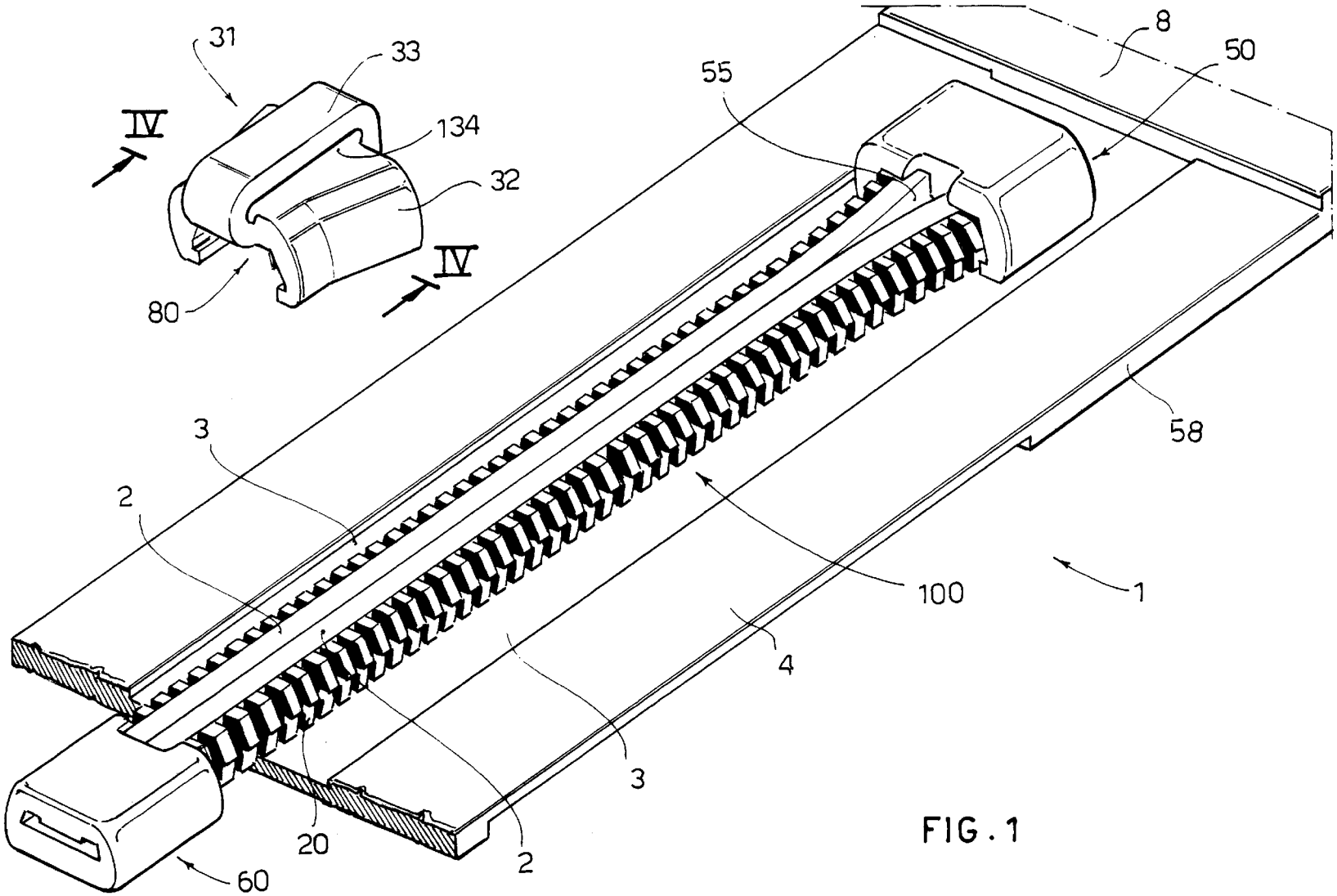
FIG. 1 is an axonometric view of a linear profile according to the invention with the slider exploded.
Figure 2:
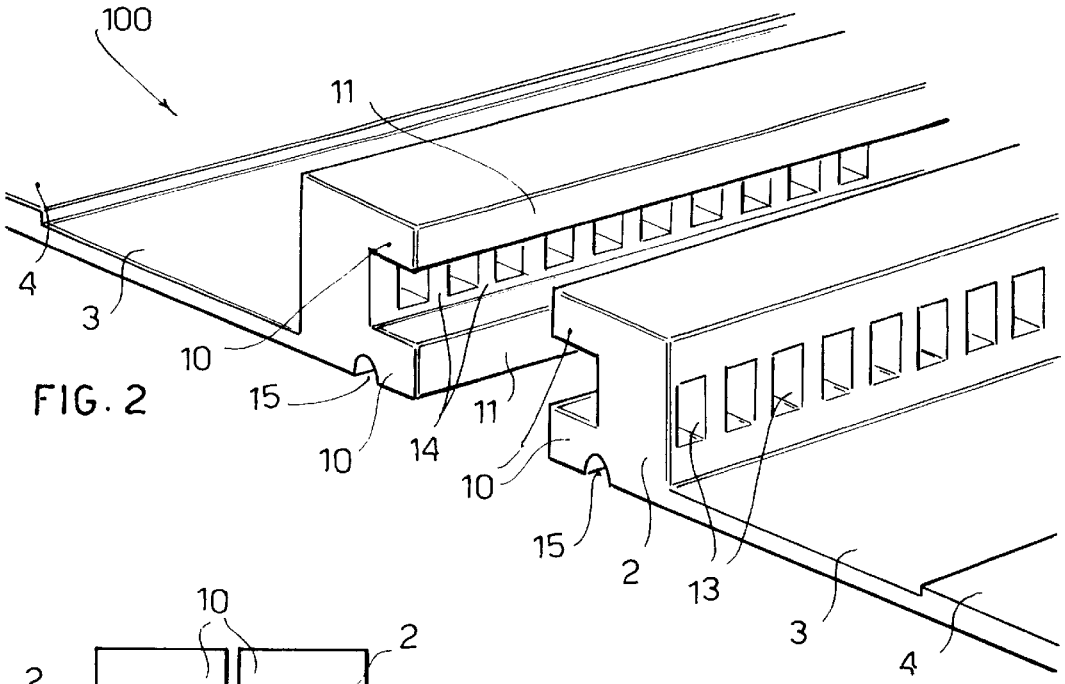
FIG. 2 is an axonometric view of the elastic element of the profile in FIG. 1.
Figure 2A:
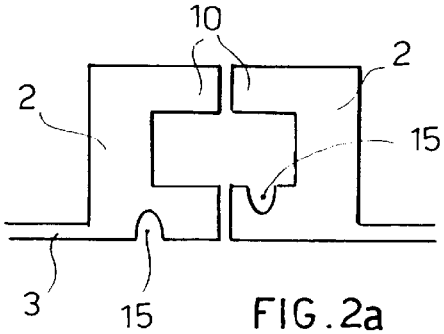
Figure 3:
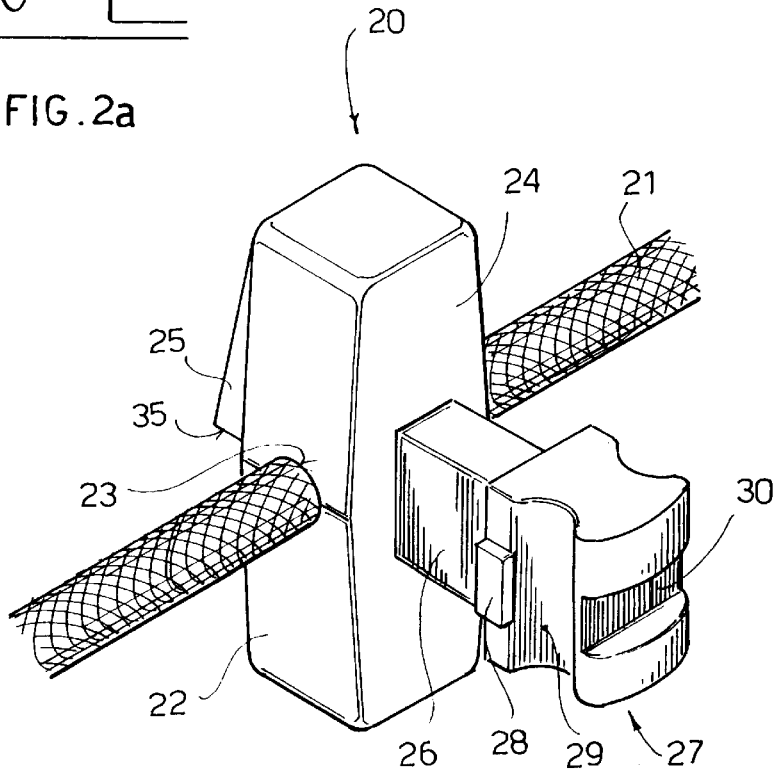
Figure 4:
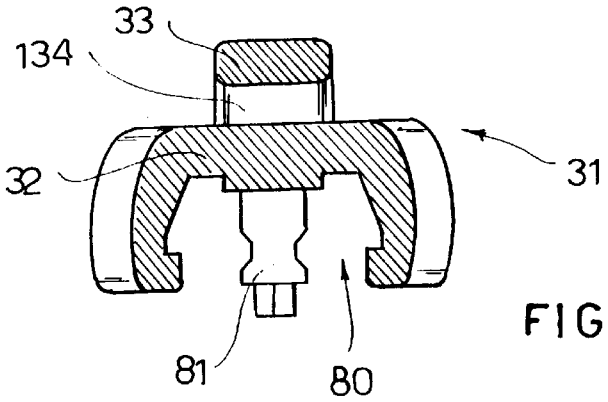
Figure 5:
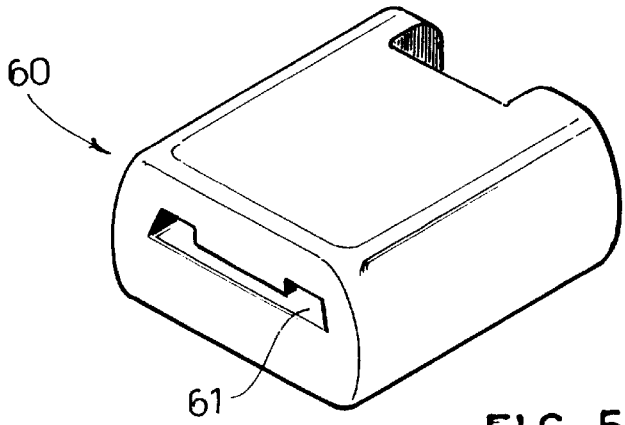
Figure 6:
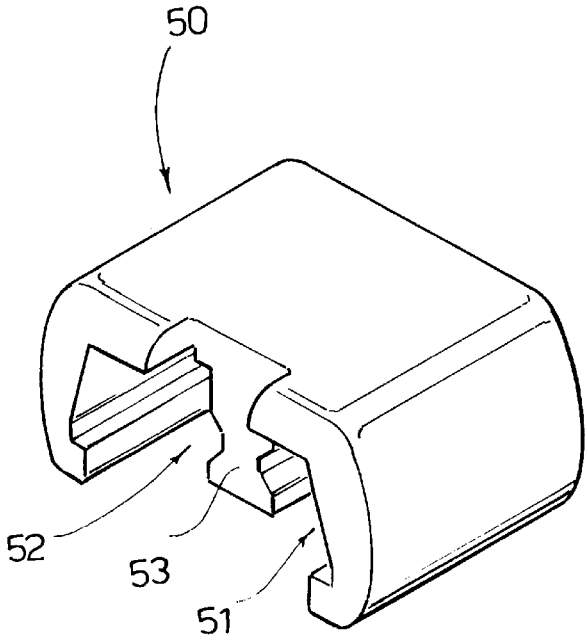

FIG. 2*a* is a cross section of a further embodiment of the elastic element in FIG. 2;

FIG. 3 is an axonometric view of a single tooth of an engaging element of the linear profile;

FIG. 4 is a cross section of the slider, along the section line IV—IV in FIG. 1;

FIG. 5 is an axonometric view of a bottom stop bridge;

FIG. 6 is an axonometric view of a top stop bridge.

The linear profile, which is self-sealing by mechanical engagement according to the invention will be described with the aid of the figures.

As shown in FIG. 1, an assembled watertight and airtight linear profile or slide fastener, which is indicated as a whole with reference number 1, consists of an elastic element 100, engagement elements 20 fixed thereto and a slider 31 which by sliding on the engagement elements 20 causes closing of two half-chains or seals 2 of the elastic element 100.

The elastic element 100, shown as a whole in FIG. 2, is produced by extrusion or through a single molding operation and the elastomer materials that can be used can preferably be either of the thermoplastic type or obtained by vulcanization.

Each seal 2 of the elastic element 100 is substantially U-shaped in section, the two ends of the U forming a double lip 10. Each lip 10 has a sealing contact surface 11 that abuts against the contact surface of the opposed lip.

The shorter side of each seal 2 with a U-shaped section has a longitudinal honeycombed rib through which passes a series of through cavities 13, substantially rectangular in section, suitable in size and pitch for subsequent forced housing of the mechanical engagement elements 20.

In the bottom part of each seal 2 a longitudinal groove is provided 15 for relief of lateral tensioning. The longitudinal groove 15 further ensures a better seal between the contact surfaces 11, which are compressed against each other through the action of internal pressure. In fact, the pressure of the inner environment sealed by the profile 1 generates forces that act on the bottom surface of the elastic element 100 causing dilatation of the longitudinal grooves 15 and thus greater compression of the lips 10 of the seals.

In cases of pressure exerted both from the inside and from the outside, respective longitudinal grooves 15 with cavities facing in opposite directions can be provided on the two seals 2 (FIG. 2*a*).

In fact, stresses due to lateral traction loads exerted on the elastic element 100 or through the effect of accentuated folds, could cause a temporary loss of contact between the lower sealing surfaces 11. The longitudinal groove 15 allows the effects of the described stress to be confined within the outermost position of the linear profile 1, allowing the system to be relatively indifferent to possible harsher conditions of use.

The run of the slider 31 along the engagement elements 20 is defined by two bridges 50 and 60. The bridges 50 and 60 are added to the elastic element 100 following extrusion or molding and then wrapped and sealed in added elastic material.

As shown in FIG. 6 the bridge 50 has a substantially E-shaped section. The bridge 60 has two cavities 51 and 52 which engage with the two end parts of the seal 2 and a central protrusion 53 which maintains the two seals 2 slightly apart so as to form a hollow space 55 (FIG. 1) for parking of the slider 31, when the seals 2 are closed. Obviously the bottom surface of the elastic element 100, beneath the hollow space 55, must be coated and sealed by means of a coating or membrane 58 to ensure the tightness of the seals.

As shown in FIG. 5, the bridge 60 is formed by a block having a cavity 61 suitable to receive the other two terminal parts of the seals 2 keeping them compressed together.

The two seals 2 and the bridges 50 and 60 are connected to respective elastic side membranes 3 that can easily be temporarily deformed when they are affected by limited tensions. The side membrane 3 consists only of elastomer material and performs an certain damping function with respect to any possible limited overload.

The side membrane is surrounded by an outer membrane 4 with a reinforcing thickening and possible embedding of a textile insert in the elastomer mass. If the elastic element 100 is produced by molding, this embedding can take place together with the single molding operation. If the elastic element 100 is produced by extrusion, embedding of the supporting elastic element takes place later and jointly with the extrusion.

A possible terminal connecting membrane 8 between the outer bands 4 reinforced with textile inserts can be provided. Said terminal membrane 8, often being subjected to particularly seer stress, can have ribs and increases in thickness with respect to the elastic membrane 4.

The engagement element of each seal 2, as a whole, consists of a series of single engaging elements or teeth 20 aligned along a textile carrying cord 21.

The single tooth 20, as shown in FIG. 3, consists of a heel 22, a lowered central body 26 and a retaining head 27.

The carrying cord 21 joining the single teeth 20 is inserted and blocked in a through hole 23 in the heel 22 during molding. Both the regularity of pitch and the longitudinal stability of the entire seal 2 depend upon solid embedding of the cord in the through-hole 23 of the heel 22. The wall 24 of the heel 22 facing the inside of the tooth 20 forms the containing and compression surfaces of the seal 2, inside which the engagement element will subsequently be forced.

The outward facing walls of the heel 22, on the other hand, undergo the sliding friction of the slider 31. The outward facing upper wall of the heel 22 forms a sloping wall 25 that has a horizontal projecting surface 35 at the bottom to contain and guide the slider 31.

Said projecting surfaces 35 of each single tooth 20, if aligned in succession, form a guideline for sliding of the slider 31. The basic function assigned to the projecting surfaces 35 is that of allowing mutual engagement of the corresponding engagement elements 20, by means of the cursor 31.

The heel 22, in the central part of its inner surface 24, is connected to the lowered body 26 which is substantially parallelepiped in shape. The lowered body 26 is of a such a size with respect to the cavity 13 of the honeycombed rib 14 as to dilate the cavity 13 that receives it until it is firmly retained therein. The snug and forced adherence of the elastic walls of the cavity 13 to the lowered body 26 is of great importance for the purposes of the tight seal of the linear profile 1.

The retaining head 27 is made at the end of the lowered body 26, said head having as a whole a greater thickness than the lowered body 26. The head 27 consists of the hooking shoulders 28 protruding sidewards with respect thereto and a centrally situated narrowing that forms the neck 29 of the head 27. The greater thickness of the head 27 with respect to the lowered body 26 provides stable anchoring of the engagement element 20 inside each cavity 13 of the honeycombed rib 14.

The head 27 has a hollow 30 in its end part.

The linear profile 1, as shown in FIG. 1, will be closed and maintained in this state through mutual engagement of the engagement elements 20. Mutual engagement takes place by means of locking of two opposite teeth in the hollow 30 between two adjacent shoulders 28 and this operation is carried out by the slider 31.

The slider 31 consists of a body 32 with a parallelepiped shape having a substantially C-shaped cross section (FIG. 4) so as to form a cavity 80 destined to engage with the engagement elements 20. An initial part of the cavity 80 is of such a size as to maintain the two seals 2 in contact; the cavity 80 gradually widens and in its end part there is a separating element 81 that serves to part the two seal elements 2, so as to cause disengagement of the engagement elements 20.

On the outer upper surface of the body 32 of the slider 31 a bridge 33 is connected longitudinally forming a cavity 134 with the body of the cursor that allows possible later insertion of puller element for easy gripping.

The ends 34 of the shorter sides of the body 32 of the slider 31 face inward and form two inner longitudinal surfaces that are in contact with the series of projecting surfaces 35, causing stable engagement of the slider 31 on the side membrane 3. Manual operation of the slider 31 along the two seals 2 that are in the open position causes gradual drawing together of the teeth 20 contained in the narrowest part of the cavity 80 of the slider, and thus mutual engagement thereof.

On completion of the closing stroke, the slider 31 abuts against the bridge 50. The slider 31 maintains the opposite profiles in a state of forced, reciprocal opposition on its inside, in the narrowest part of the cavity 80, whilst the separating element 81 of the slider stays in the hollow space formed by the bridge 50.

Subsequent sliding of the slider 31 in the opposite direction to that for closure allows the profiles to be parted through the effect of the separating element 81 and thus the teeth 20 to be gradually disengaged resulting in complete opening of the seals 2.

The end point of the opening stroke of the slider 31 is provided by the bridge 60. The bridge 60 therefore acts as a stop bar for the slider 31 thus preventing it from coming off the profile.

I claim:

1. A linear profile, which is self-sealing by mechanical engagement, comprising an elastic support comprising a pair of opposite seals destined to receive respective series of engagement elements that can be brought into mutual engagement by means of a slider, wherein each seal has a double lip at each end of which a respective sealing contact surface is provided enclosing a longitudinal honeycomb rib crossed by a series of through cavities destined to receive said engagement elements, and wherein said engagement elements comprise teeth aligned along a carrying cord, each tooth comprising a heel, a lowered central body and a retaining head and being inserted and elastically retained in a respective through cavity of one of the two seals.

2. A linear profile according to claim 1, characterized in that said heel, in its outward facing surface, has a projecting surface at the top to contain and guide the slider.

3. A linear profile according to claim 1, characterized in that a longitudinal groove is made in the bottom surface of each seal for relief of longitudinal tension.

4. A linear profile according to claim 3, characterized in that said two longitudinal grooves have cavities, facing in opposite directions, to ensure a better seal of the contact surfaces following pressure exerted in the directions of said longitudinal grooves.

5. A linear profile according to claim 1, characterized in that said linear profile comprises two bridges that form two end stop points for the slider.

6. A linear profile according to claim 1, characterized in that the seals and the bridges are surrounded by an elastic side membrane that is easily deformable if affected by limited tensions.

7. A self sealing linear profile comprising:

a pair of opposite seals, each seal comprising a longitudinal rib forming a plurality of through cavities, and a pair of lips on opposed sides of the longitudinal rib, each lip comprising a respective sealing surface;

a plurality of engagement elements, each engagement element comprising a heel, a central body and a retaining head, each engagement element inserted and elastically retained in a respective one of the through cavities; and a slider coupled with the engagement elements to bring the engagement elements into mutual engagement.

8. The linear profile according to claim 7, wherein the lips are positioned and configured such that the sealing surfaces contact one another on both sides of the engagement elements when the engagement elements are mutually engaged.

* * * * *